US006069348A

United States Patent [19]

Roginski

[11] Patent Number: 6,069,348

[45] Date of Patent: May 30, 2000

[54] METHOD AND APPARATUS FOR INDUCTIVELY HEATING NON-CIRCULAR WORKPIECES

[75] Inventor: James A. Roginski, Hinckley, Ohio

[73] Assignee: Tocco, Inc., Madison Hts., Mich.

[21] Appl. No.: 09/232,919

[22] Filed: Jan. 19, 1999

[51] Int. Cl.[7] ..... H05B 6/40

[52] U.S. Cl. ..... 219/635; 219/639; 219/650; 219/652; 219/676; 148/572; 266/92; 266/129

[58] Field of Search ..... 219/639, 635, 219/640, 647, 652, 650, 672, 676; 148/572, 569, 573; 266/129, 92

[56] References Cited

U.S. PATENT DOCUMENTS 3,823,927 7/1974 Budzinski .
4,618,125 10/1986 Balzer ..... 219/639
5,796,078 8/1998 Ottenwaelder et al. ..... 219/639

FOREIGN PATENT DOCUMENTS 520 220 2/1993 European Pat. Off. .
38 18679 12/1988 Germany .
40 29 724 10/1992 Germany .

*Primary Examiner*—Philip H. Leung
*Attorney, Agent, or Firm*—Vickers, Daniels & Young

[57] ABSTRACT

Apparatus for inductively heating and hardening diesel cam shaft lobes includes a table supporting an inductor for radial displacement relative to the lobe of a workpiece to be hardened and a master component having a lobe identical to that of the workpiece to be hardened and supported for rotation about an axis parallel to and laterally spaced from that of the workpiece. The master component and workpiece are rotated in synchronism, and a follower roll on the table engages the lobe of the master component to accurately maintain a desired air gap between the inductor and lobe of the workpiece during the hardening operation.

17 Claims, 6 Drawing Sheets

METHOD AND APPARATUS FOR INDUCTIVELY HEATING NON-CIRCULAR WORKPIECES

BACKGROUND OF THE INVENTION

This invention relates to the art of induction heating and, more particularly, to an improved method and apparatus for inductively heating and hardening surfaces having a non-circular profile relative to the workpiece axis of rotation and/or having a non-uniform mass geometry adjacent to the heated area of the workpiece.

The present invention finds particular utility in connection with the heating and hardening of diesel cam shaft lobes and, accordingly, will be disclosed in detail in connection with such use.

At the same time, it will be appreciated that the invention is applicable to the induction heating of non-circular surface profiles and/or adjacent areas of non-uniform mass geometry in workpieces other than diesel or other cam shaft lobes.

The selective hardening of the non-circular profiles of the cam lobes for heavy duty diesel engine applications presents major challenges with respect to producing a reasonable, acceptable, uniform depth of hardening to provide a highly durable, long wearing surface which, in use, can be subjected to high applied hertzian operational stress. The mass geometry configurations of these cam shafts can be substantially complex in that the cam profiles are varied and include both positive and negative ramp profiles modified for specialized operating requirements. In addition, there are special applications such as the integral ejector cam on a diesel cam shaft which can have a different set of cam profile variables and, in use, have higher hertzian stress levels and a higher engaged surface contact velocity. The mass geometry arrangements are further complicated by the diameter of the basic shaft section between adjacent cams which can substantially change the thermal mass inertia around the circumference of the cam surface, particularly when the diameter of the basic shaft literally matches the cam surface at the heel of the cam.

To rotate a cam of the foregoing character about the axis of an encircling inductor does not provide for obtaining an inductive heating of the outer surface to a predetermined depth of heating and, accordingly, in connection with quenching of the heated surface, does not enable achieving a uniform hardened depth along the peripheral surface of the cam. Moreover, inductive heating in the foregoing manner does not enable any selectivity with respect to varying the inductor coupling with the cam to compensate for profile changes, mass geometry variations and energy density changes in connection with achieving a desired depth of heating. Further, while both the power to the inductor and the rotational speed of the cam shaft can be varied, these capabilities, in connection with an encircling inductor, do not lend to achieving the desired uniform depth of heating and hardening of the cam. Still further, while uniform heating and depth of hardening might be achieved through the use of multiple or split type inductors (with contacts) which in combination provide an interior contour corresponding to the cam profile, such an arrangement would result in a high power requirement, particularly in light of the large surface areas of the cams of diesel cam shafts and this, together with the plural or split inductor requirement would lend to undesirably high production and operating costs. Moreover, production costs would be unacceptably increased by the fact that each different cam profile would require a separate inductor configuration. Still further, the multiple or split inductor arrangement providing an internal bore corresponding to the cam profile would not lend to compensating for large variations in circumferential thermal mass situations with respect, for example, to the basic shaft problem referred to hereinabove, and would not lend to selectively increasing the heated or hardened depth in a particular area of the cam profile where for example, there are higher applied stresses during use of the cam. A further problem with prior heating methods is the possibility of stray heating of adjacent cam surfaces.

SUMMARY OF THE INVENTION

In accordance with the present invention, an improved method and apparatus is provided for heating an outer surface of a workpiece rotatable about a workpiece axis with respect to which the outer surface is non-circular. More particularly in accordance with the invention, a method and apparatus are provided by which a more uniform depth of heating and depth of hardening of a non-circular workpiece profile is obtainable than heretofore possible and by which a wide variety of complex profiles can be more economically and efficiently inductively heated and hardened than through the use of methods and apparatus heretofore available. Still further in accordance with the invention, a method and apparatus for inductively heating and hardening a non-circular workpiece profile is operable to achieve a uniform depth of heating and hardening circumferentially of the non-circular profile with a single inductor of structurally simple and economic construction.

In accordance with one aspect of the invention, an inductor for inductively heating a non-circular outer surface of a workpiece rotating about a workpiece axis is mounted on an inductor support which is displaceable toward and away from the surface of the workpiece so as to maintain the inductor in a desired inductively coupled relationship with the surface as the workpiece is rotated about its axis. The latter is achieved by synchronously rotating the workpiece and a master component having an outer surface profile identical to that of the workpiece and displacing the workpiece support through the use of the master profile so that the inductor scans the outer surface of the workpiece so as to maintain the desired coupled relationship therewith for obtaining the desired depth of heating circumferentially of the outer surface of the workpiece. Preferably, the mechanical scanning is achieved by rotating the master component and workpiece at a constant speed and providing a fixed power input to the inductor. The surface profile of the master component can be altered to adjust the inductive coupling to a desired coupling in accordance with the particular profile of a workpiece being created. Further, both the speed of rotation and the inductive power can be varied during the process, thus enabling varying the rate of energy input into the workpiece along the outer surface thereof to obtain the desired uniform depth of heating in connection with not only changes in the surface profile of the workpiece but also mass geometry variations and the like. The ability to vary the inductive coupling and/or the rotational speed and/or the power input to the inductor advantageously enables preferentially increasing the heated and hardened depth in those areas of a profile where there may be higher applied stress during use of the hardened workpiece. Such increased hardened depth may be particularly important in ramp areas of a cam where the roller follower velocity is accelerated during use causing a sliding component in addition to the applied hertzian stress level.

In accordance with another aspect of the invention, a control system is provided for induction heating apparatus by which the inductor coupling can be varied and/or the power input to the inductor can be varied and/or the angular velocity or rotational speed of the workpiece can be varied so as to optimize obtaining a desired uniform depth of heating or hardening a non-circular workpiece surface having a complex profile and/or profile changes, having mass geometry variations about the periphery thereof, and/or requiring energy density changes to produce a required depth of heating and the desired uniformity with respect to the heated or hardened depth. The ability to vary the rotational speed additionally enables an increase in rotational speed following heating to improve the quenching operation in connection with hardening the workpiece surface. Still further in accordance with this aspect of the invention, the inductor can be operated to axially scan the non-circular workpiece surface during rotation thereof, thus enabling an inductor of given width to be used in connection with non-circular surfaces of widths greater than that of the inductor.

The use of a single inductor together with the ability to variably control one or more of the inductive coupling, rotational speed and inductor power input advantageously minimizes inductor cost and enables minimizing the time required to change the control system for operation with a different non-circular workpiece surface profile. Moreover, minimum operator skill is required, and operation of the control system optimizes achieving the objective of obtaining and maintaining a desired depth of heating and hardening about the periphery of a given non-circular workpiece surface profile.

It is accordingly an outstanding object of the present invention to provide an improved method and apparatus for inductively heating an outer surface of a workpiece rotatable about a workpiece axis with respect to which the outer surface is non-circular.

Another object is the provision of a method and apparatus of the foregoing character which optimizes achieving a desired depth of heating and hardening circumferentially about the non-circular workpiece surface.

A further object is the provision of a method and apparatus of the foregoing character which optimizes achieving a uniform depth of heating and hardening of a non-circular workpiece surface to provide a highly durable and long wearing surface for a workpiece subject to high applied hertzian operational stress.

Still another object is the provision of a method and apparatus of the foregoing character which enables achieving a desired depth of heating and hardening in connection with a workpiece in which the non-circular profile of the circumferential outer surface changes and the workpiece has mass geometry variations and wherein energy density changes are necessary to produce a desired depth of heating and hardening.

Yet a further object is the provision of a method and apparatus of the foregoing character in which any one or more of the process parameters of inductor coupling, rotational speed of the workpiece and power input to the inductor can be selectively varied to achieve a desired depth of heating and hardening about the circumference of the workpiece surface.

Still a further object is the provision of a method and apparatus of the foregoing character in which the inductor can be axially scanned along the workpiece surface during rotation of the workpiece so as to enable the desired depth of heating and hardening in a workpiece surface which is axially wider than the inductor.

Yet another object is the provision of a method and apparatus of the foregoing character in which axial scanning enables pattern profiling in an axial direction to handle axial profiles and/or undesirable heating of geometrically exposed edges or unwanted stray heating of adjacent surfaces.

Another object is the provision of a method and apparatus of the foregoing character in which a wide range of non-circular workpiece surface profiles can be accommodated with minimal time and effort required to convert between heating and hardening operations relative to workpiece surfaces having different profiles.

Still a further object is the provision of a method and apparatus of the foregoing character which enables selectivity with respect to preferentially increasing the heating and hardened depth on areas of a workpiece profile in which a higher stress is applied in connection with use of the workpiece.

Still another object is the provision of a method and apparatus of the foregoing character which enables selectively obtaining a uniform depth of heating and hardening about the circumference of a workpiece surface, or a depth of heating and hardening which varies about the circumference of the workpiece surface.

BRIEF DESCRIPTION OF THE DRAWINGS

The foregoing objects, and others, will in part be obvious and in part pointed out more fully hereinafter in conjunction with the written description of preferred embodiments illustrated in the accompanying drawings in which.

DESCRIPTION OF PREFERRED EMBODIMENTS

Figure 1:
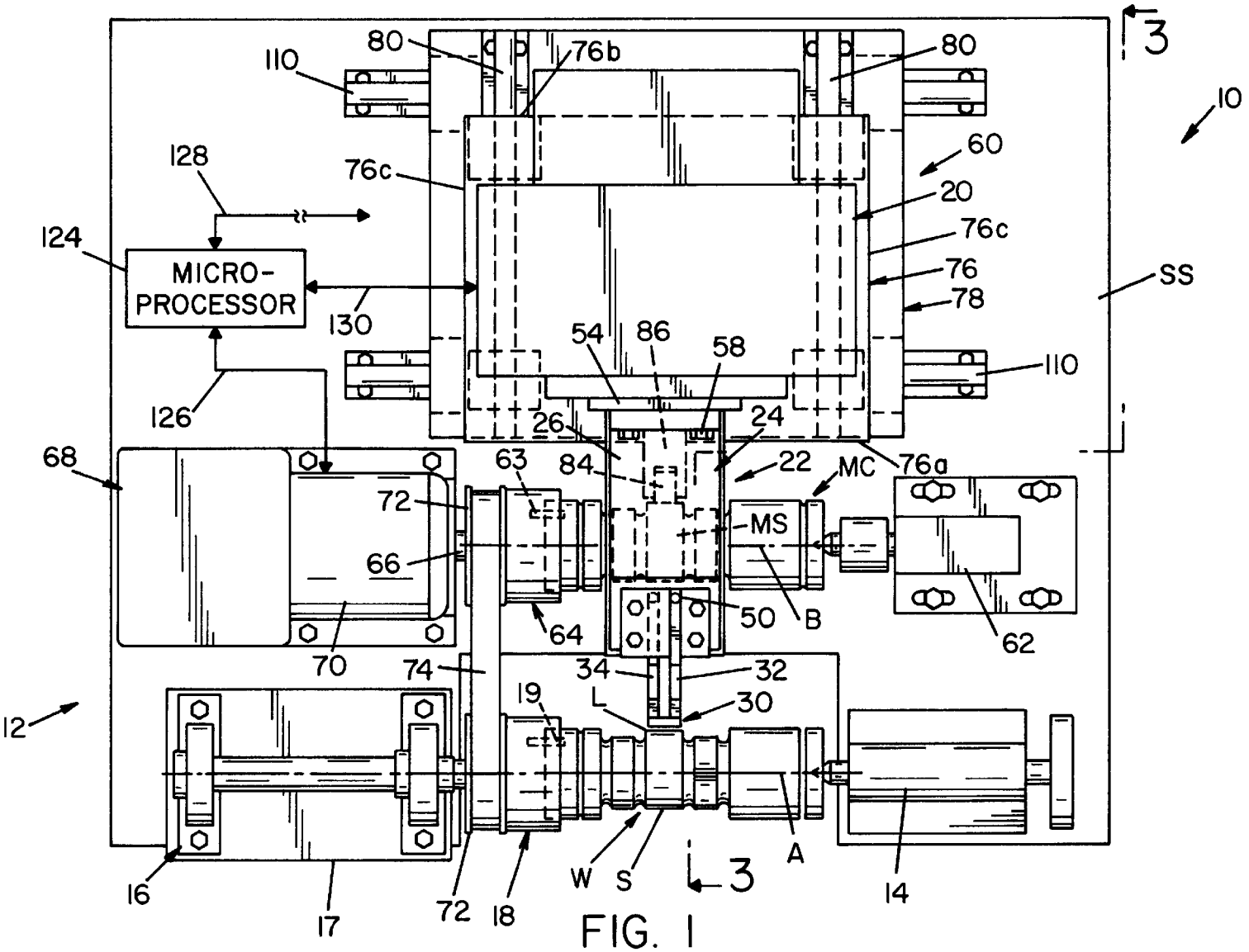
FIG. 1 is a plan view of one embodiment of induction heating apparatus and a control arrangement therefor in accordance with the present invention.
Figure 2:
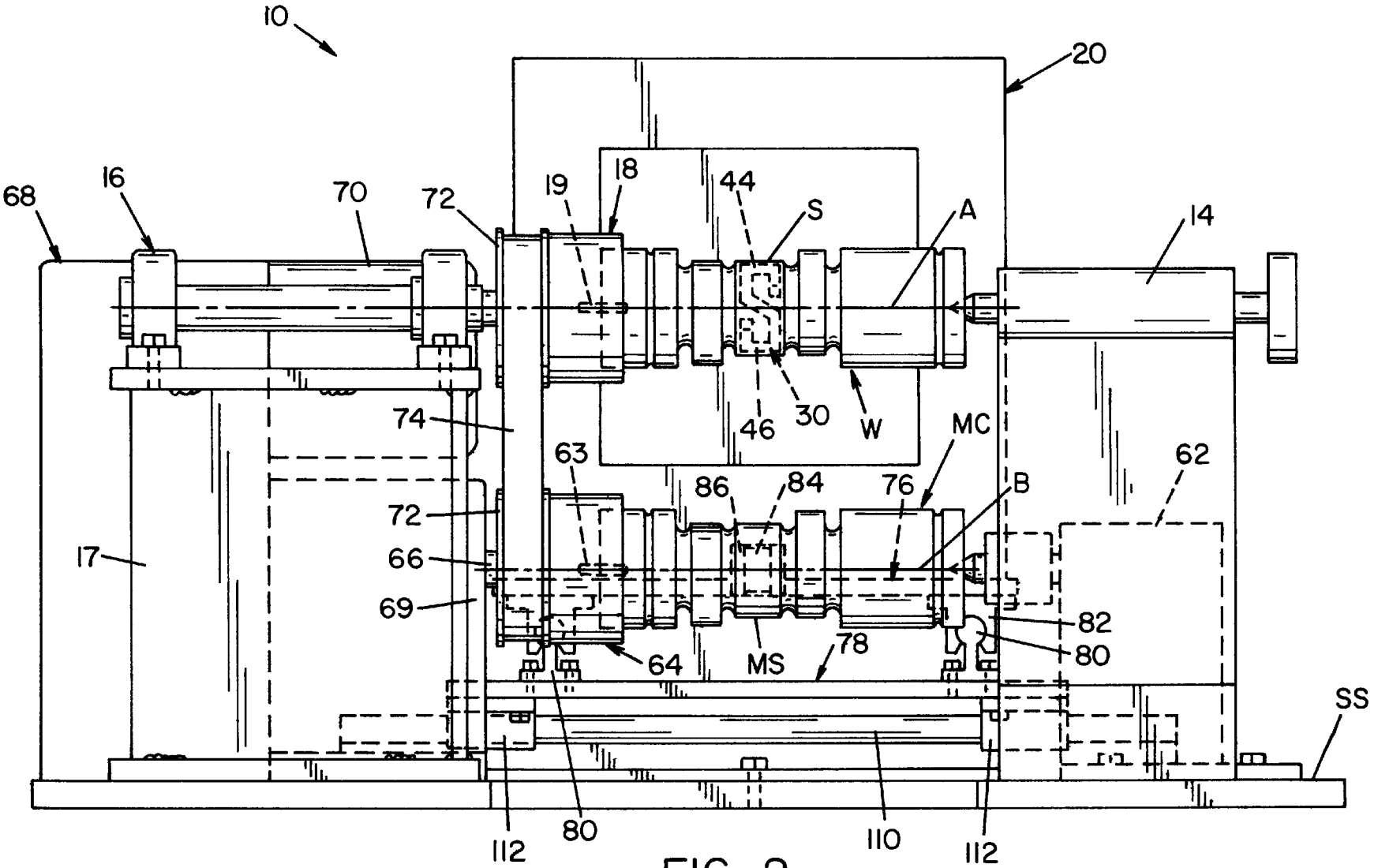
FIG. 2 is a front elevation view of the apparatus shown in FIG. 1.

Referring now in greater detail to the drawings wherein the showings are for the purpose of illustrating a preferred embodiment of the invention only and not for limiting the invention, FIGS. 1–6 illustrate induction heating apparatus 10 for inductively heating a workpiece W and wherein the inductively coupled relationship between the workpiece and inductor 12 is controlled by a master component MC for obtaining a uniform depth of heating about the periphery of the surface of the workpiece to be hardened and, accordingly, in connection with quenching of the workpiece, a uniform depth of hardening below the workpiece surface. Workpiece W has an axis of rotation A and an outer surface S to be heated and which surface is non-circular relative to axis A. In the embodiment herein illustrated, workpiece W is a diesel engine cam shaft and surface S is the outer surface of cam lobe L of the cam shaft. In the embodiment illustrated, workpiece W is supported for rotation about axis A by means of a center 14 at one end and a pillow block and shaft assembly 16 mounted on a support stand 17 at the other end and. The pillow block and shaft assembly includes a drive coupling 18 with which the corresponding end of workpiece W is keyed, such as by a pin 19, so as to be driven by the coupling as set forth more fully hereinafter.

Figure 3:
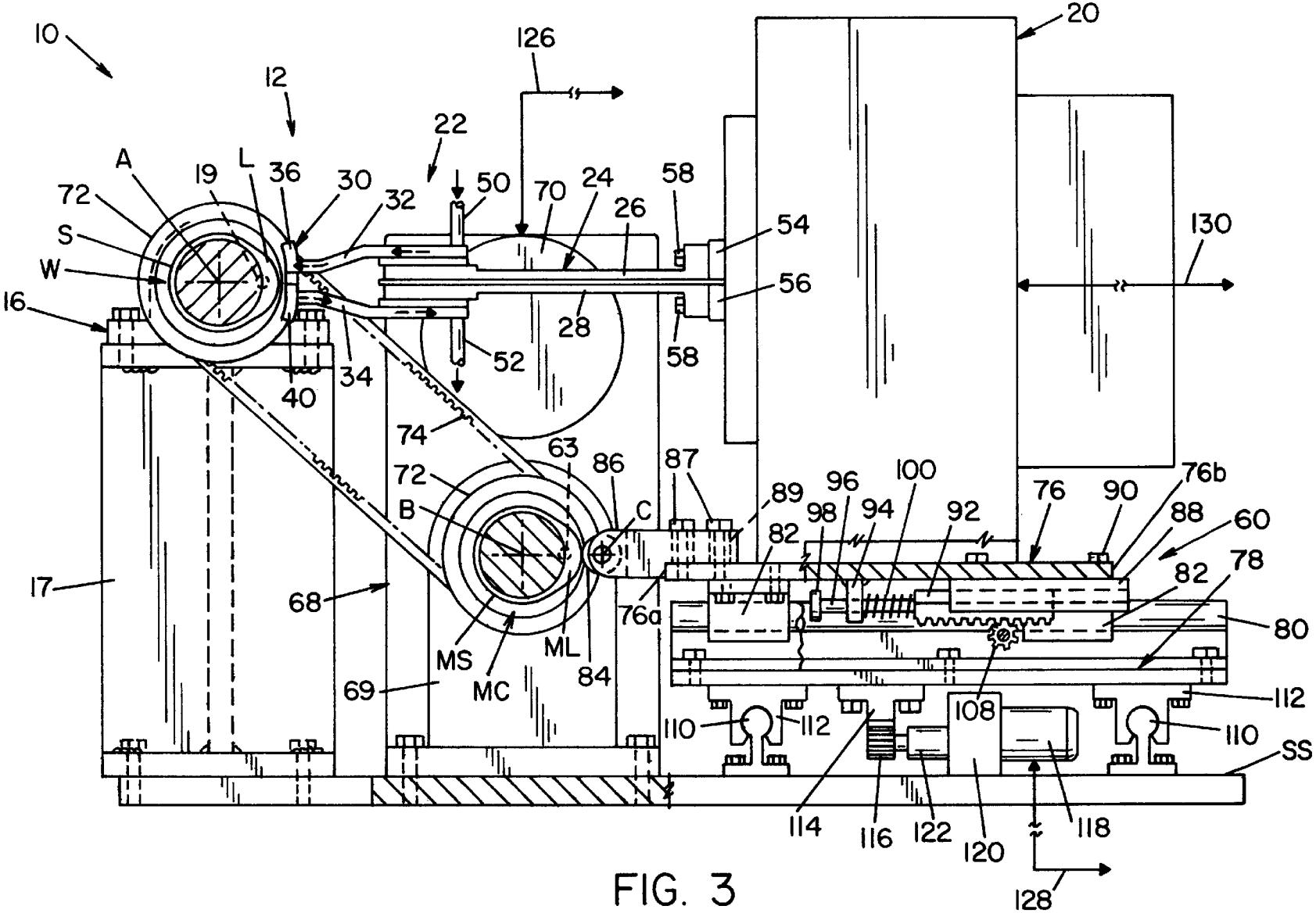
FIG. 3 is an elevation view of the apparatus, partially in section, taken along line 3—3 in FIG. 1.
Figure 4:
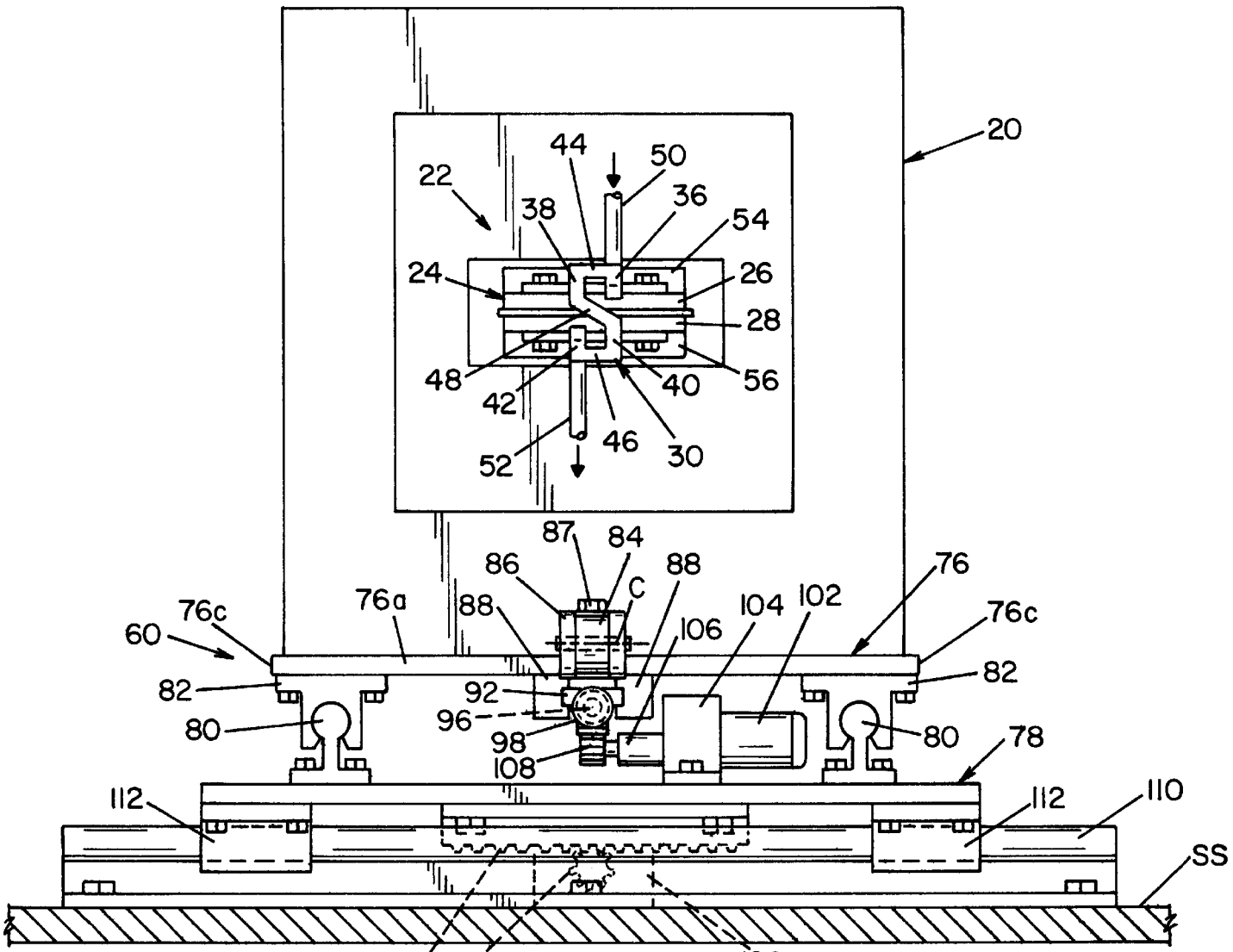
FIG. 4 is a front elevation view of the inductor support and inductor of the apparatus shown in FIG. 1.
Figure 5:
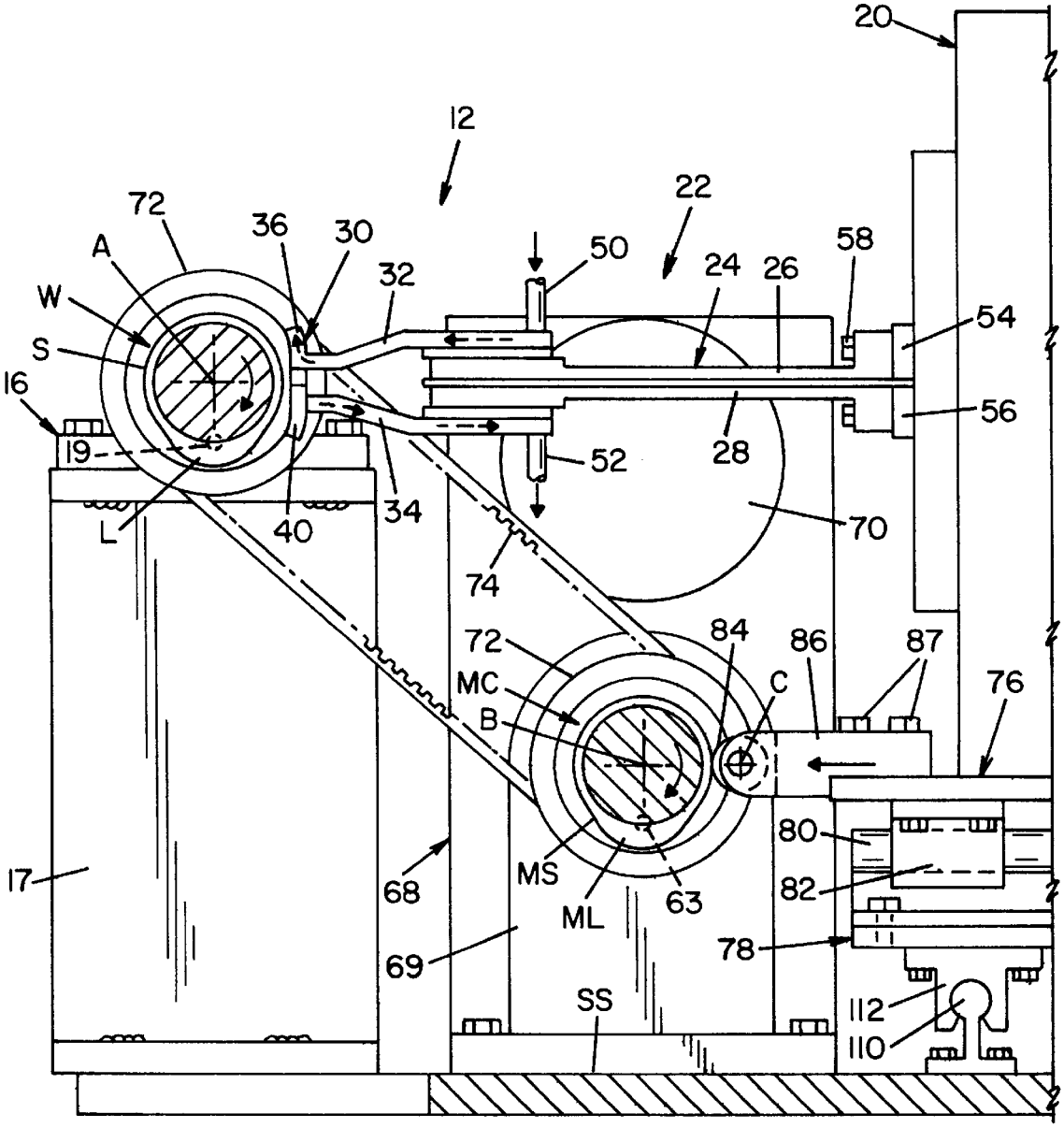
FIG. 5 is a sectional elevation view of the master and workpiece cam shafts similar to FIG. 3 and showing the lobes rotated 90° clockwise from the positions shown in FIG. 3; and, FIG. 6 is a sectional elevation view similar to FIG. 5 and showing the cam shaft lobes rotated 180° from the positions shown in FIG. 3.
Figure 6:
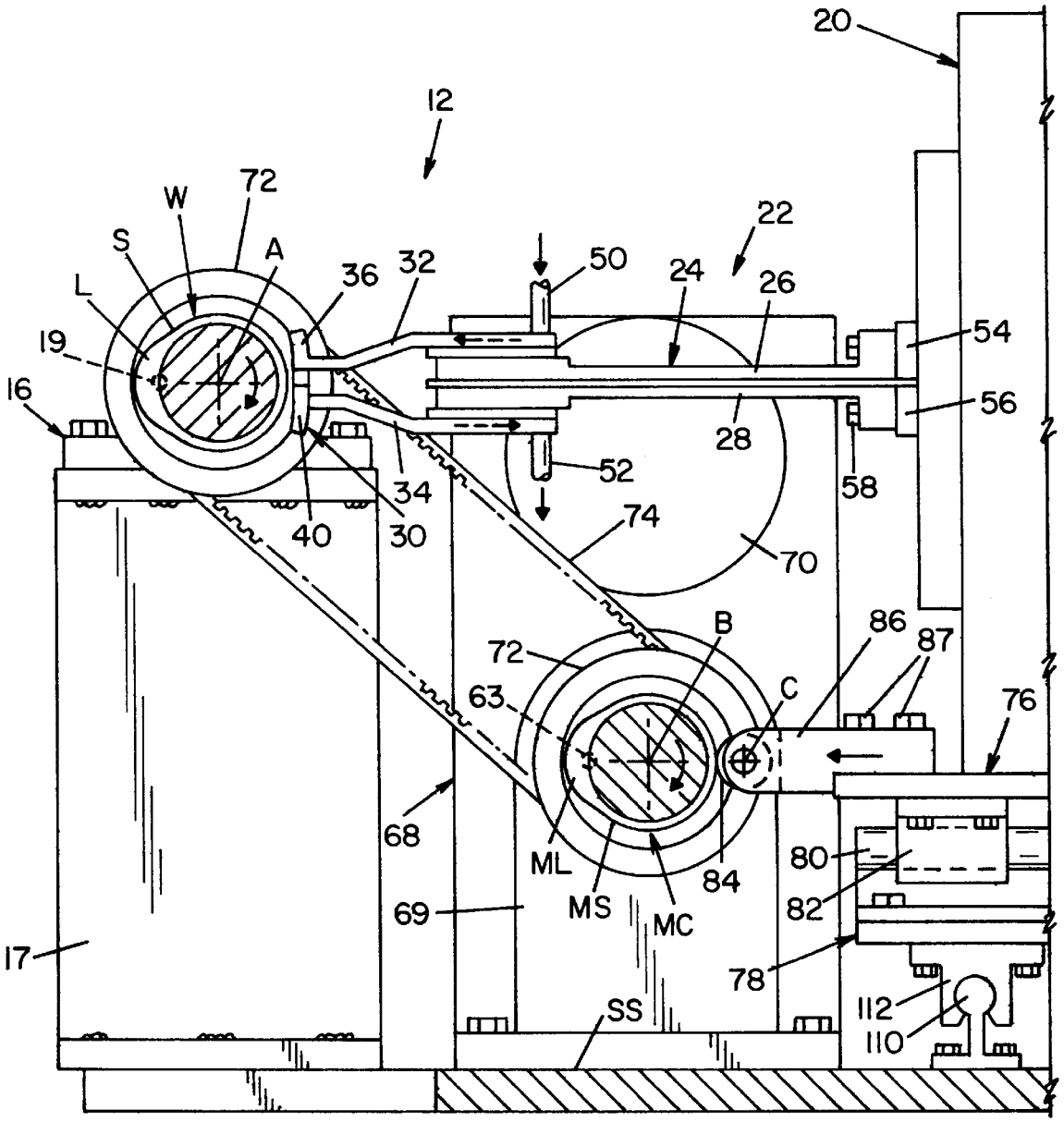

Induction heating apparatus 10 includes a housing 20 and an inductor unit 22 mounted on and extending forwardly of the housing. Inductor unit 22 includes a support arm portion 24 comprising upper and lower conductor members 26 and 28, and an inductor 30 in the form of a tubular copper conductor having its opposite ends 32 and 34 respectively connected to conductor members 26 and 28 of support arm 24. As best seen in FIGS. 3 and 4 of the drawing, inductor 30 is continuous between ends 32 and 34 thereof and is contoured to provide leg portions 36, 38, 40, and 42 connected in series between ends 32 and 34 by axially extending leg portions 44 and 46 respectively between leg portions 36 and 38 and leg portions 40 and 42, and by a laterally extending leg portion 48 between leg portions 38 and 40. This structural configuration provides axially adjacent inductor portions which, as will be appreciated from FIG. 3, are of a contour and dimensions for lobe L of workpiece W to rotate without engaging the inductor. Conductor members 26 and 28 of support arm 24 provide for connecting inductor ends 32 and 34 across a suitable source of alternating current in a well known manner, and ends 32 and 34 of the inductor are connected by inlet and outlet tubing 50 and 52, respectively, to a suitable source of cooling fluid which is circulated through the inductor during an induction heating operation. The source of alternating current, not illustrated, may include a transformer which is enclosed in housing 20 and has secondary terminal components 54 and 56 to which the inner ends of conductor members 26 and 28 are fastened, respectively, such as by bolts 58.

Power supply housing 20 and thus inductor 22 are mounted on a support and carriage assembly 60 which, as described in greater detail hereinafter, tracks master component MC during an induction heating operation so as to obtain and maintain a desired inductively coupled relationship between inductor 30 and workpiece W as the latter rotates about axis A. Master component MC is identical to workpiece W, is rotatable about an axis B which is parallel to and spaced laterally from axis A and, with respect to cam L on workpiece W includes an identical cam ML. Master component MC is supported at one end for rotation about axis B by a center 62 and has its opposite end coupled by a pin 63 to a drive coupling 64 similar to drive coupling 18. Drive coupling 64 is mounted on and rotatable with output shaft 66 of a gear box unit 68 having an output portion 69 from which shaft 66 extends. Shaft 66 is driven through gear box 68 by an electric motor 70, and drive couplings 18 and 64 at the corresponding ends of workpiece W and master component MC are provided with pulley components 72 which are preferably toothed for interconnection by an internally ribbed endless belt 74. Accordingly, it will be appreciated that workpiece W is rotated in synchronism with and at the speed as master component MC in response to rotation of the latter by motor 70 and gear box 68. It will be appreciated too that workpiece W and master component MC are angularly positioned relative to the corresponding one of the axes A and B for lobes L and ML to be identically positioned relative to a reference plane such as horizontal.

Support and carriage assembly 60 mentioned above comprises an upper table 76 which is displaceable toward and away from master component MC in the manner described hereinafter, and housing 20 is mounted for movement therewith. The support and carriage assembly further includes a lower table 78 which is displaceable axially of the workpiece and master component in the manner set forth hereinafter. Upper table 76 is mounted on table 78 for displacement axially therewith and for displacement relative thereto in the direction toward and away from the workpiece and master component. More particularly in this respect, lower table 78 is provided with a pair of rails 80 mounted thereon in axially spaced apart and perpendicular relationship with respect to axes A and B. Upper table 76 has front and rear ends 76*a* and 76*b*, respectively, and is provided with a pair of rail engaging support blocks 82 for each rail 80, the blocks of each pair being mounted on the underside of table 76 adjacent the front and rear ends thereof As will be appreciated from FIGS. 3 and 4 of the drawing, blocks 82 interengage with rails 80 to support upper table 76 for sliding displacement toward and away from workpiece W and master component MC.

The front end of table 76 is provided with a follower roller 84 mounted on the front end of a roller support arm 86 which in turn is secured to table 76 generally centrally between opposite sides 76*c* thereof. More particularly, arm 86 is attached to table 76 such as by bolts 87 and, preferably, as best seen in FIG. 3, arm 86 is provided with enlarged or elongated openings 89 for bolts 87, whereby arm 86 and thus follower roller 84 are adjustable outwardly and inwardly relative to front end 76*a* of the table. Arm 86 supports roller 84 for rotation about an axis C which is parallel to axis B and, as will be appreciated from FIG. 3, axis C lies in a horizontal plane through axis B. It will also be appreciated that follower roller 84 and inductor 30 are aligned with one another in a plane transverse to axes A and B and thus with respect to the axial dimensions of the lobe surfaces and MS of the workpiece and master component. Roller 84 engages the outer surface of master lobe ML and is maintained thereagainst during rotation of the master component by a biasing spring arrangement between upper table 76 and lower table 78. More particularly in this respect, a pair of rack support blocks 88 are mounted on the underside of table 76 such as by bolts 90, and a rack member 92 is disposed between blocks 88 and is supported thereby for sliding displacement in the direction between the front and rear ends of table 76. The underside of table 76 is further provided with an abutment plate 94 which is apertured to slidably receive a guide rod 96 mounted on and extending forwardly from rack member 92 and having a stop member 98 on the outer end thereof and on the side of abutment plate 94 facing front end 76*a* of the table. A compression spring 100 is interposed between rack member 92 and abutment plate 94 in surrounding relationship with respect to guide rod 96 and operates to bias upper table 76 relative to rack member 92 in the direction towards master component MC. Further in this respect, a rack drive motor 102 is mounted on lower table 78 against displacement relative thereto and is operable through a gear box 104 to drive an output shaft 106 on which a pinion 108 is mounted for driving rack member 92 and thus table 76 toward and away from master component MC. As will be appreciated from FIG. 3, operation of motor 102 to rotate pinion 108 clockwise displaces rack member 92 outwardly relative to master component MC whereby, when stop member 98 engages abutment plate 94, table 76 and thus follower roller 84 is displaced radially away from master component MC. Operation of motor 102 to displace pinion 108 counterclockwise in FIG. 3 displaces table 76 toward master component MC for follower roller 84 to engage the outer surface of master lobe ML, whereupon further displacement of rack member 92 to the left in FIG.

3 compresses spring 100 and thus biases follower roller 84 against the master lobe.

Lower table 78 is displaceable axially of master component MC for the purposes of axially scanning a lobe being heated and aligning follower roller 84 and thus inductor 30 with another lobe on the corresponding one of the master cam and workpiece axially spaced from lobes L and ML. For this purpose, the underlying support surface SS for the induction heating apparatus is provided with a pair of rail members 110 which are spaced apart and extend parallel to one another and to axes A and B, and the underside of lower table 78 is provided with pairs of support blocks 112 slidably interengaging with rails 110 to support table 78 and thus table 76 thereon for axial displacement relative to workpiece W and master component MC. Further, the underside of lower table 78 is provided with a rack member 114, and a drive pinion 116 interengages therewith for displacing table 78 in axially opposite directions relative to rails 110. More particularly in this respect, a pinion drive motor 118 is mounted on support surface SS and is operable through a gear box 120 and output shaft 122 on which pinion 116 is mounted to rotate the latter in opposite directions.

It is believed that operation of the apparatus for inductively heating and hardening lobe L of workpiece W will be understood from the foregoing description. Briefly in this respect, when workpiece W and master component MC are mounted between their respective support components for rotation, and the lobes L and ML thereof are aligned angularly relative to the corresponding one of the axes A and B, table 76 is advanced forwardly for follower roller 84 to engage surface MS of lobe ML of the master component. Support arm 86 is then adjusted as may be necessary to provide the desired air gap between inductor 30 and surface S of lobe L of workpiece W for the heating and hardening thereof Motor 70 is then started, whereby master component MC is rotated about axis B and workpiece W is simultaneously and synchronously rotated about axis A. Upon energization of the power supply for inductor 30, surface S of workpiece lobe L is inductively heated to a desired depth after which a quenching liquid is applied to the workpiece to obtain a desired depth of hardness for the lobe. As will be appreciated from FIGS. 3, 5 and 6, as master component MC and workpiece W rotate about their respective axes, follower roller 84 engages and follows lobe surface MS of master component MC and operates through support and carriage assembly 60 to maintain the desired air gap at the exact circumferential location on surface S of workpiece lobe L as is contacted by follower roller 84 on surface MS of the master component.

The master component and workpiece can be rotated at a uniform speed, but it will be appreciated that, in connection with different cam profiles, it may be advantageous to vary the speed of rotation of the master component and thus the workpiece and/or to incrementally rotationally scan the workpiece to optimize the inductive heating and hardening to a desired depth below the outer surface of the cam and/or to vary the power output to the inductor during rotation of the master component and workpiece at a constant, variable or incremental speed for the same purpose of optimizing obtaining a desired depth of hardening and to accommodate circumferential mass variation. It will likewise be appreciated that inductor 30 can be axially narrower than shown and that motor 118 can be operated to displace table 78 and thus inductor 30 axially of the workpiece and master component so that the inductor axially scans lobe L as the latter rotates about axis A, either at a uniform and/or variable speed. Furthermore, as will be appreciated from FIGS. 1 and 3, the foregoing functions of master cam drive motor 70, carriage drive motor 118 and the power output of the inductor can be controlled through the use of a microprocessor 124 programmed to output control signals thereto respectively through lines 126, 128 and 130.

While considerable emphasis has been placed herein on a preferred embodiment of the invention, it will be appreciated that other embodiments can be devised and that many changes can be made in the preferred embodiment without departing from the principles of the invention. Accordingly, it is to be distinctly understood that the foregoing descriptive matter is to be interpreted merely as illustrative of the present invention and not as a limitation.

Having thus described the invention, it is so claimed:

1. Apparatus for inductively heating an outer surface of a workpiece rotatable about a first horizontal axis with respect to which said outer surface is non-circular comprising, an inductor having ends for connection to a power source, a radially reciprocable inductor support for positioning said inductor in inductively coupled relationship with said outer surface, a master component rotatable about a second horizontal axis parallel to and laterally spaced from said first axis, said master component having a master surface relative to said second axis corresponding in contour to said outer surface of said workpiece, means for synchronously rotating said workpiece and said master component, and a follower on said inductor support engaging said master surface for translating rotation of said master component into reciprocation of said inductor support for providing a predetermined depth of heating radially inwardly of said outer surface of said workpiece.

2. Apparatus according to claim 1, wherein said means for synchronously rotating said workpiece and said master component includes a motor for rotating one of said workpiece and said master component, and an endless belt interconnecting said one and the other of said workpiece and said master component.

3. Apparatus according to claim 2, wherein said motor rotates said master component.

4. Apparatus according to claim 3, and programmable means for controlling at least one of the power output to said inductor and the operation of said motor.

5. Apparatus according to claim 1, wherein said inductor support is supported for displacement in axially opposite directions relative to said workpiece and said master component.

6. Apparatus according to claim 1, and a biasing device biasing said inductor support in the direction to bias said follower against said master surface.

7. Apparatus according to claim 6, wherein said biasing device includes a spring.

8. Apparatus according to claim 1, wherein said second axis is below said first axis and laterally spaced therefrom in a given direction, said inductor support including a table laterally spaced from said master component in said given direction and having a front end facing said master component, said follower being on said table and extending outwardly of said front end, and said inductor being mounted on said table and extending outwardly of said front end and across said master component.

9. Apparatus according to claim 8, wherein said table is slidably mounted on a pair of rails extending transverse to said first and second axes, and means for biasing said table relative to said pair of rails in the direction of engagement of said follower with said master surface.

10. Apparatus according to claim 9, and drive means for displacing said table in opposite directions along said pair of rails.

11. Apparatus according to claim 9, wherein said table is a first table and said pair of rails is a first pair of rails, and further including a second table slidably mounted on a second pair of rails extending parallel to said first and second axes, said first pair of rails being mounted on said second table for displacement therewith along said second pair of rails.

12. Apparatus according to claim 11, wherein said means for synchronously rotating said workpiece and said master component includes a drive motor for rotating said master component and an endless belt interconnecting said master component and said workpiece.

13. Apparatus according to claim 12, wherein said drive motor is a first drive motor, a second drive motor for displacing said second table in opposite directions along said second rails, and programmable means for controlling at least one of the power output to said inductor, the operation of said first drive motor and the operation of said second drive motor.

14. Apparatus according to claim 12, wherein each said workpiece and said master component has a driven end and an opposite end, the driven ends being laterally aligned, and the workpiece surface and master surface being laterally aligned in a location between the driven and opposite ends of said workpiece and said master component.

15. Apparatus according to claim 14, wherein said means for synchronously rotating said workpiece and said master component further includes a drive coupling for the driven end of each said workpiece and said master component, said endless belt being trained about the drive couplings, and a gear reducer having an output shaft drivingly connected to said drive coupling on said driven end of said master component, said motor being drivingly connected to said gear reducer.

16. Apparatus according to claim 15, and first and second table drive motors for respectively displacing said first and second tables in opposite directions along said first and second pairs of rails.

17. Apparatus according to claim 16, and programable means for controlling at least one of the power output to said inductor, the operation of said drive motor for rotating said master component, and the operation of said second table drive motor.

* * * * *